US005839850A

United States Patent [19]

Noguchi et al.

[11] Patent Number: 5,839,850

[45] Date of Patent: Nov. 24, 1998

[54] ROAD TRAFFIC SIGN OF SOLID GRAPHIC PATTERN

[75] Inventors: Kazuhiro Noguchi, Takatsuki; Nobuhisa Deki, Kyoto; Takeshi Nagata, Takatsuki; Yohei Inagaki, Hirakata, all of Japan

[73] Assignee: Sekisui Jushi Kabushiki Kaisha, Osaka, Japan

[21] Appl. No.: 775,645

[22] Filed: Dec. 31, 1996

[30] Foreign Application Priority Data

May 13, 1996 [JP] Japan ..... 8-118031

[51] Int. Cl.[6] ..... E01F 9/04

[52] U.S. Cl. ..... 404/9; 404/12; 116/63 R; 40/612

[58] Field of Search ..... 404/9, 12, 14, 404/15, 16; 40/612; 116/63 R

[56] References Cited

U.S. PATENT DOCUMENTS 2,318,722 5/1943 Smith et al. ..... 404/9 X
2,834,133 5/1958 Carmack ..... 404/9 X
3,768,383 10/1973 Tucker ..... 404/9 X
5,456,546 10/1995 Bullag ..... 404/14 X

*Primary Examiner*—James Lisehora
*Attorney, Agent, or Firm*—Seed and Berry LLP

[57] ABSTRACT

The following constitution is employed for enhancing the visual recognition of a road traffic sign by presenting a road traffic sign composed of a solid pattern having shades as visual image. A marking pattern divided into plural sections is tightly formed on the road, and the adjacent sections are mutually different in lightness, so that, in the road traffic sign of the invention, a solid figure is recognized as the visual image of the marking pattern. Herein, the adjacent sections have a lightness difference of 1 or more in Munsell value, and the lightness of each section is selected at lightness in two to four stages set at mutually different Munsell values. Moreover, when the adjacent sections are colored in hues mutually different in lightness, a more solid visual image will be obtained due to the difference in hue among the sections.

13 Claims, 11 Drawing Sheets

ROAD TRAFFIC SIGN OF SOLID GRAPHIC PATTERN

BACKGROUND OF THE INVENTION

The present invention relates to a road traffic sign formed on a road so as to be visually recognizable by a passer-by or a driver of a running vehicle.

To assure safety of road traffic, various road traffic signs are drawn on the road surface. When these road traffic signs are visually recognized by the passers-by and drivers, caution is alerted and safety is assured. Hitherto, these road traffic signs were generally characters and patterns drawn as a flat pattern, and it was not sufficient to alert attention to vehicles running at high speed, in particular, and these road traffic signs were often overlooked.

Accordingly, for vehicles running at high speed, by drawing lateral lines at equal intervals on the road surface, it was intended to cause the driver to recognize the sensation of speed and slow down the speed intentionally. In Great Britain, white zigzag lines are drawn at both sides of the road surface near the pedestrian crossing, and it is intended so that the driver may recognize the presence of pedestrian crossing and slow down the speed intentionally. Such road traffic signs can enhance the visual recognition, but, same as in the above prior art, it is still likely to be overlooked because the form of sign is a flat pattern recognition.

Accordingly, instead of the road traffic sign for flat pattern recognition, it is also attempted to bulge part of the road surface, so that the bulged part may be recognized to slow down the speed forcedly. In this method, however, if the vehicle rides over the bulge at high speed, it causes noise, and is accompanied by danger. It also needs tremendous labor in the work for bulging part of the road surface.

OBJECT AND SUMMARY OF THE INVENTION

Figure 1:
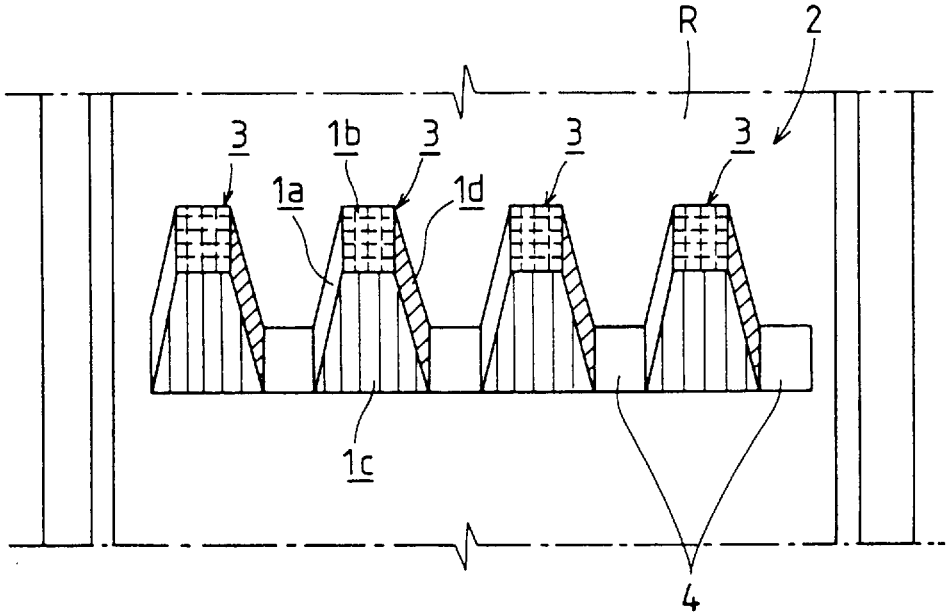
FIG. 1 is a plan view showing a constitution of an embodiment of the invention.

It is hence an object of the invention to enhance the visual recognition of road traffic sign, prevent danger in road traffic, and ensure smooth traffic, by presenting a road traffic sign composed of a solid pattern having shades as visual image.

To achieve the object, the road traffic sign of solid graphic pattern of the invention is a road traffic sign composed of a marking pattern divided in plural sections, formed tightly on the road, in which adjacent sections differ in lightness from each other, so that the solid image of the visual image of the marking pattern may be recognized. Herein, the solid image of the visual image includes, for example, convex and concave shape, and is any one in which a three-dimensional image can be recognized. In this constitution, adjacent sections mutually have a lightness difference of Munsell value of 1 or more, and the lightness of each section is selected in a lightness of two to four stages individually set at different Munsell values. Herein, by setting of lightness in two to four stages, the process for forming a solid pattern to be drawn is easy and practical when the number of plane portions is two to four. In manufacture of this road traffic sign, for example, by preparing sheet pieces differing in lightness in two to four stages, they can be used generally.

Or, adjacent sections may be colored in the hue mutually different in lightness.

In this constitution, since the adjacent sections are mutually different in lightness, shades are expressed in the marking pattern, and in this marking pattern, a solid image can be recognized as visual image. Moreover, in the constitution in which the lightness difference of adjacent sections are set at 1 or more of Munsell value and the lightness of each section is selected in the lightness of two or four stages individually set at different Munsell values, enough and sufficient shades to be recognized as solid image can be formed, and the visual recognition is enhanced. It is the most preferred to employ the lightness difference of adjacent sections being set at 2 or more Munsell value. In such a case, a more solid visual image can be obtained. Moreover, when adjacent sections are colored in the hue individually different in lightness, a more solid visual image can be obtained by the difference in hue of sections, and the visual recognition is further improved. Still more, in the road traffic sign of the invention, if the vehicle rides over this road traffic sign, although it is recognized as a solid image visually, it is not actually bulged up, and hence it is not accompanied by danger.

In a preferred embodiment of the invention, the shape of the material for composing the sections may include sheet, plate, block, coat film, etc.

The sheet material may be obtained by curing rosin resin, petroleum resin, other hot-melt, epoxy resin, polyester resin, other synthetic resin, or acrylic compound. By adhering such sheet materials on the road surface, the marking pattern is formed.

Plate and block materials may include artificial stone concrete, concrete, brick, tile, glass, asphalt, metal, synthetic resin, and ceramics. This metal materials may include color iron and steel sheet and alminum plate. These materials are partly buried in the road, and partly exposed.

As the coat film materials, for example, water-based paint, oil-based paint, colored white cement, colored asphalt, colored emulsifier, material used as the above sheet material, other sheet form material and other paints are used. In this constitution, the paint is applied on the road surface. In the constitution of such coat film, the road sign can be installed relatively at low cost, and it does not require huge machinery for installation, and hence the installation is easy.

Furthermore, these materials may be mixed with recursive reflection material such as glass beads, or light reserve material such as strontium aluminate and zinc sulfide. In the composition blended with such recursive reflection material or light reserve material, a sufficient lightness may be maintained at night only by a slight illumination or headlight, and the visual recognition is not lowered.

Incidentally, when drawing a marking pattern on the road, it is preferred to employ a stereographic technique such as conformal projection and gradient method. In such a case, an accurate solid image is obtained, and the reliability as solid image is high.

DESCRIPTION OF THE PREFERRED EMBODIMENTS

Referring now to the drawings, preferred embodiments of the invention are described in detail below.

Figure 2:
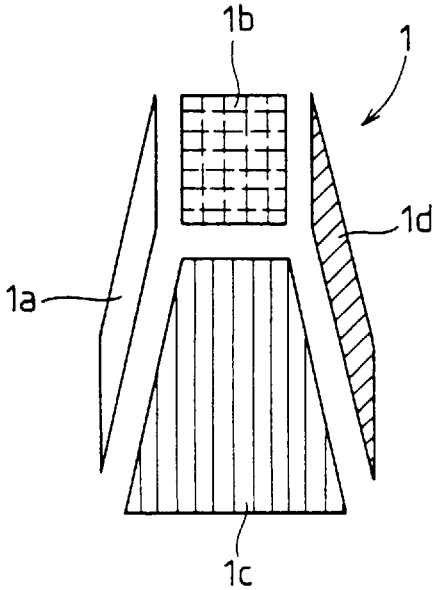
FIG. 2 is a plan view showing a form of each section in FIG. 1.

FIG. 1 is a plan view showing a constitution of an embodiment of the invention, and FIG. 2 is a plan view showing a form of each section in FIG. 1.

A road traffic sign 2 of solid graphic pattern in the embodiment of the invention is arranged on a road R in a row in a vertical direction to the running (passing) direction on the road R. This road traffic sign 2 is composed of plural marking patterns 3 . . . 3, and white linking patterns 4 . . . 4 interposed in gaps of the respective marking patterns 3 . . . 3. The patterns are composed of sheet pieces, and in the marking pattern 3, a prismoid is formed as a visual image. This prismoid is composed of a sheet piece 1*a* forming the left side in white color (Munsell value about 9), a sheet piece 1*b* forming the top side in yellow color (Munsell value about 6), a sheet piece 1*c* forming the front side in red color (Munsell value about 5), and a sheet piece 1*d* forming the right side in brown color (Munsell value about 3). The lightness of the sheet pieces 1 is highest in white, being followed by yellow, red and brown in this order. In this marking pattern 3, a solid image is formed in the arrangement in which the lightness is highest at the left side, and gradually becomes darker in the top side, front side, and right side, and the lightness difference between sheet pieces can be recognized as the shade conforming to the shade drawing technique. That is, in this solid image, the ray of light is emitted from above the left front side, and looks darker in the sequence of the top side, front side and right side, and since the lightness difference of the adjacent sheet pieces of these sheet pieces 1*a*, 1*b*, 1*c*, 1*d* is 1 or more in Munsell value, so that a sufficient shade recognized as solid image is expressed. Incidentally, as the lightness difference becomes smaller, it is harder to be recognized as shade, and the boundary value is about 1 in Munsell value, and hence the lightness difference is required to be 1 or more of Munsell value.

As such sheet piece materials, those obtained by curing rosin resin, petroleum resin, other hot-melt, epoxy resin, polyester resin, other synthetic resin, or acrylic compound may be used. Furthermore, these materials may be mixed with recursive reflection material such as glass beads, or light reserve material such as strontium aluminate and zinc sulfide. In the composition blended with such recursive reflection material or light reserve material, a sufficient lightness may be maintained at night only by a slight illumination or headlight, and the visual recognition is not lowered. By adhering such sheet materials on the road surface, the marking pattern is formed.

This sheet piece 1 may have only a lightness difference such as white, gray and black and may not have hue, but as in the above constitution, when plural sheet pieces 1*a*, 1*b*, 2*c*, 1*d* are colored in hues of different lightness degrees, the difference of sides will be more clear and it is easier to be recognized three-dimensionally. The road traffic sign 2 shown in FIG. 1 is composed of four sides, that is, left side, top side, front side, and right side, and the sheet pieces 1*a*, 1*b*, 1*c*, 1*d* are set in four stages of lightness. In the embodiment, the sheet piece 1 is composed of the same number of sheet pieces 1 as the number of sections for forming a solid pattern, but not limited to this, to express the shade more precisely, one section may be composed of plural sheet pieces.

Thus, in the structure shown in FIG. 1, plural marking patterns 3 . . . 3 are formed on the road in a row in a direction vertical to the running direction, and these marking patterns 3 . . . 3 are linked with a white linkage sheet 4 in order to form a stop-line, but this linkage sheet 4 may be omitted.

Figure 3:
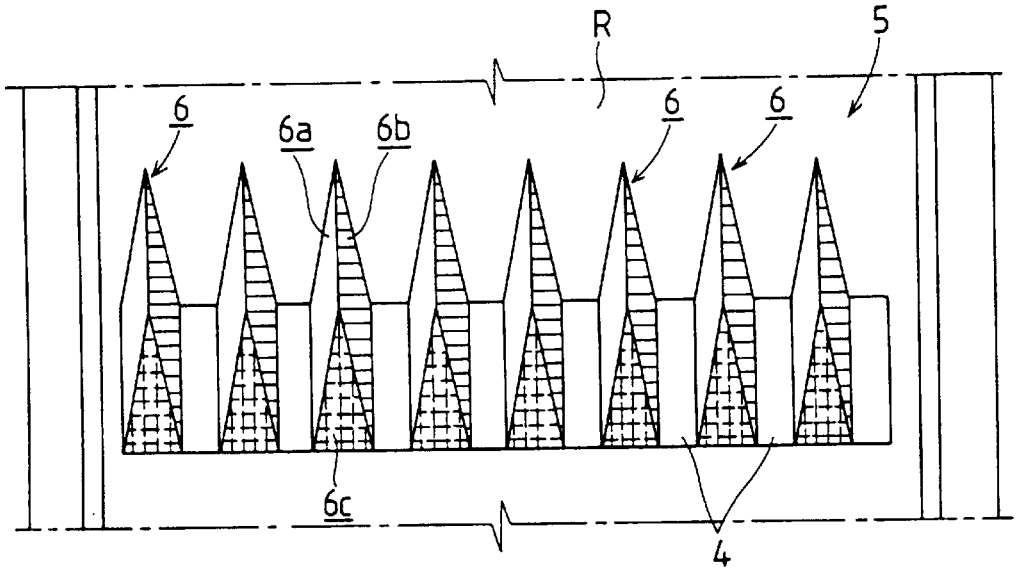
FIG. 3 is a plan view showing a constitution of other embodiment of the invention.
Figure 4:
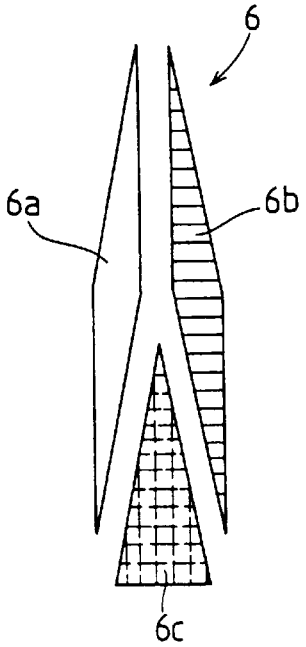
FIG. 4 is a plan view showing a form of each section in FIG. 3.

The road traffic sign 2 of solid graphic pattern is not limited to the composition composed of four sides, but as shown in FIG. 3, it may be colored in different hues in three stages of lightness, or as shown in FIG. 4, three sheet pieces 6*a*, 6*b*, 6*c* may be disposed on the left slope, right slope, and front side to compose marking patterns 5 . . . 5. These sheet pieces 6*a*, 6*b*, 6*c* are colored respectively in white (Munsell value about 9), blue (Munsell value about 3), and yellow (Munsell value about 6), and a solid pattern of a triangular shape in vertical section is formed on the whole. That is, in the marking patterns 5 . . . 5 formed on the sheet piece 6*a* of the highest lightness, yellow sheet piece 6*b* of the middle, and blue sheet 6*c* of the lowest, a solid pattern composed of the left slope of the highest lightness, and front side and right slope of the second and third lightness is formed, and this lightness difference is recognized as shade, and this shade becomes darker to the front side and right slope, and this solid pattern is recognized to be illuminated from the left front upper side of the marking patterns 5 . . . 5 in the diagram.

Thus, in the structure shown in FIG. 3, same as in FIG. 1, the marking patterns 6 . . . 6 are formed on the road in a row in a direction vertical to the running direction, and they are linked with a white linkage sheet 4 to form a stop-line, but the linkage sheet piece 4 may be omitted.

Figure 5:
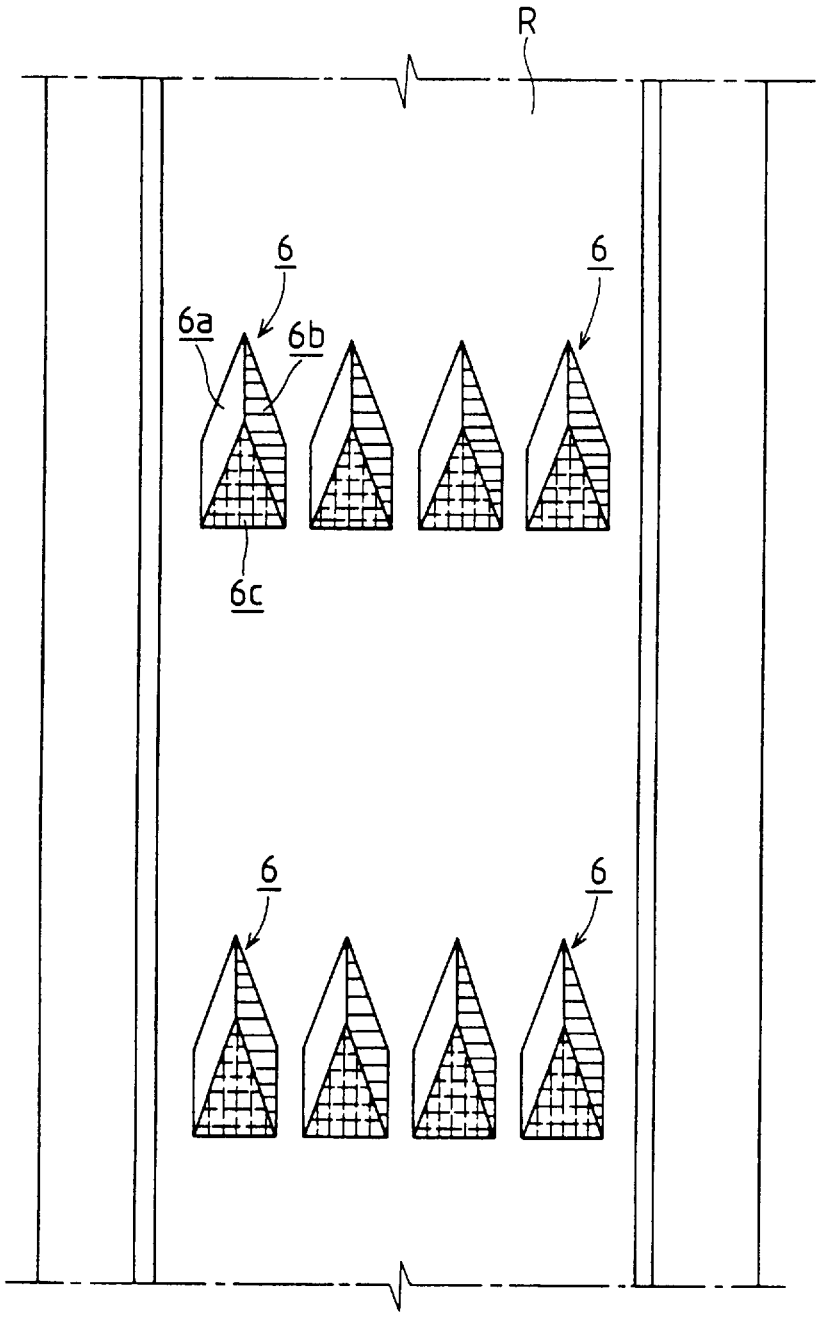
FIG. 5 is a plan view showing a state of forming a sign pattern shown in FIG. 3 on a road surface.

The example of arrangement using the marking pattern 6 in FIG. 3 is not limited to a lateral row, as mentioned above, but, for example, two-rows may be arranged laterally as shown in FIG. 5. In this case, as compared with one lateral row, the visual recognition is enhanced, and the marking effect is greater.

Figure 6:
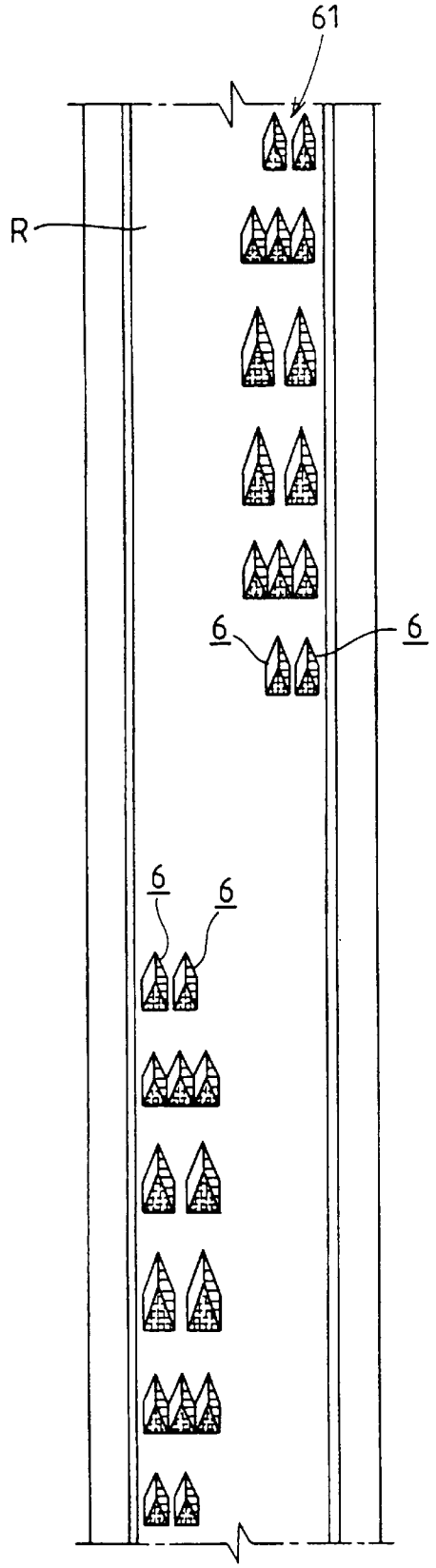
FIG. 6 is a plan view showing other state of forming a sign pattern shown in FIG. 3 on a road surface.

FIG. 6 shows a constitution of a different embodiment. In this example, the marking pattern 6 shown in FIG. 3 is arranged in plural pieces to the right and left as shown in FIG. 6, and this road traffic sign 61 urges the driver to run in an S-curve so as to avoid these marking patterns 6 . . . 6. In such arrangement, the lanes may be changed as required.

Figure 7:
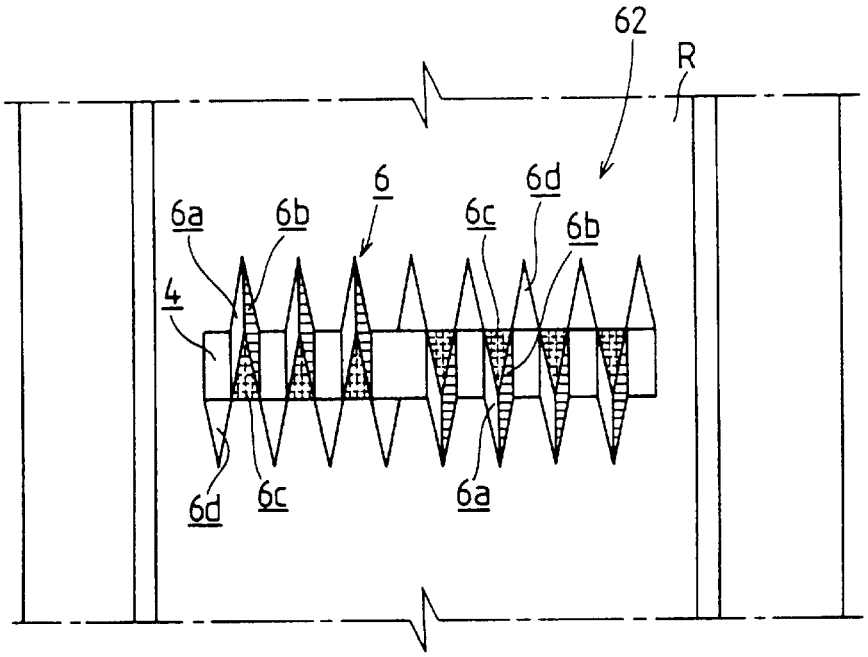
FIG. 7 is a plan view showing a constitution of a different embodiment of the invention.

FIG. 7 shows a constitution of other different embodiment. In this example, the marking pattern 6 shown in FIG. 3 is arranged as in FIG. 7, and the road traffic sign 62 is composed so as to be recognized three-dimensionally from both the running lane and the opposite lane of the road R. In this example, plural marking patterns 6 are arranged in each lane in a row in mutually reverse directions in the running lane and opposite lane, and are linked with a white linkage sheet 4 so as to mark stop-lines, and further by arranging sheet pieces 6*d* of yellow (Munsell value about 6) in inverted triangular shape before the linkage sheet 4, this triangular marking pattern 6 appears floating on the road R. Therefore, for the driver, this road traffic sign 62 is more easily recognized visually, and the visual recognition is enhanced.

Figure 8:
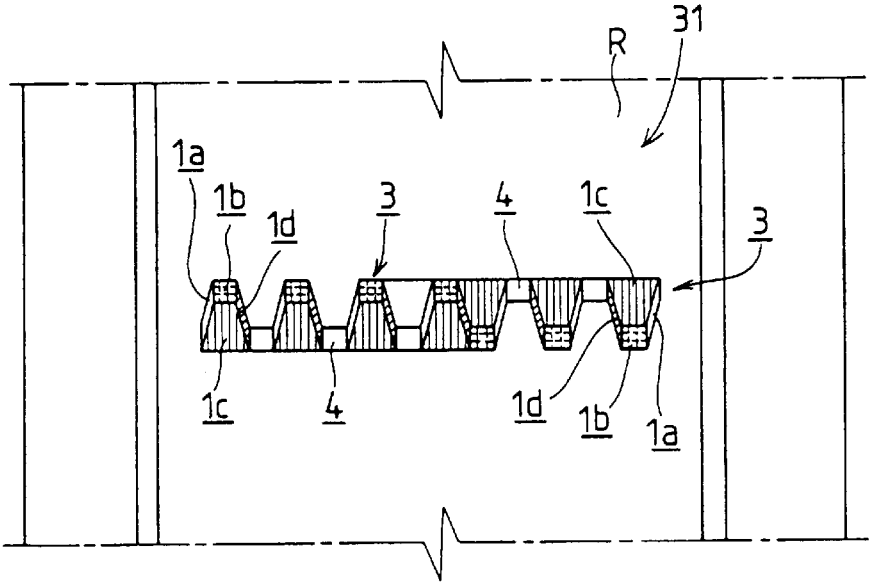
FIG. 8 is a plan view showing a state of forming the sign pattern shown in FIG. 1 on a road surface.

FIG. 8 shows a constitution of a further different embodiment. In this example, the marking pattern 3 shown in FIG. 1 is arranged as in FIG. 8, so that the road traffic sign 31 can be recognized three-dimensionally from both the running lane and the opposite lane of the road R. In this example, plural marking patterns 3 are arranged in each lane in a row in mutually reverse directions in the running lane and opposite lane, and are linked with a white linkage sheet 4 so as to mark stop-lines. The constitution of this road traffic sign 31 is, same as in the preceding embodiment, high in visual recognition.

Figure 9:
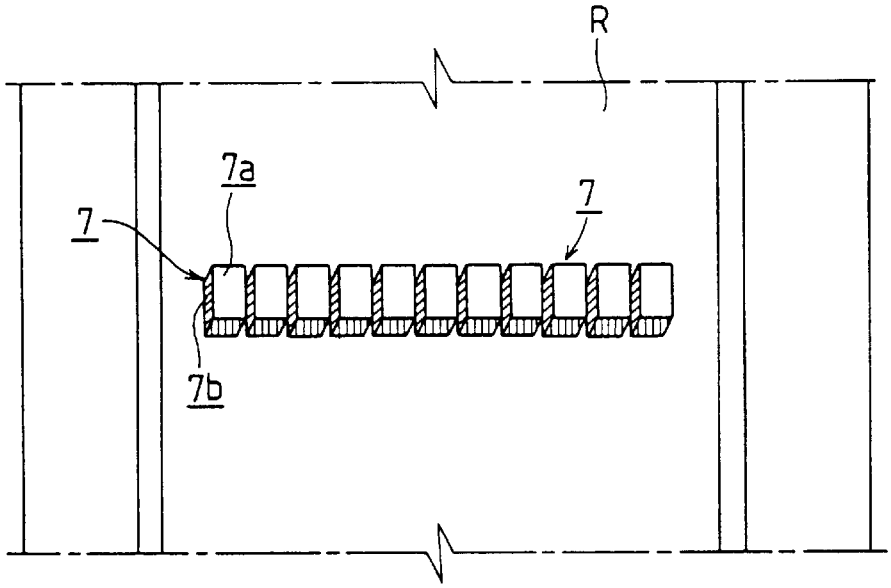
FIG. 9 is a plan view showing a constitution of other different embodiment of the invention.

Furthermore, FIG. 9 shows a constitution of a still different embodiment. In this example, the left side and front side are formed of sheet pieces 7*b* of red (Munsell value about 5), and the top side is formed of a sheet piece 7*a* of white (Munsell value about 9) to compose square columnar marking patterns 7 . . . 7, and a plurality thereof are formed on the road in a row in a direction vertical to the running direction, thereby marking stop-lines.

Figure 10:
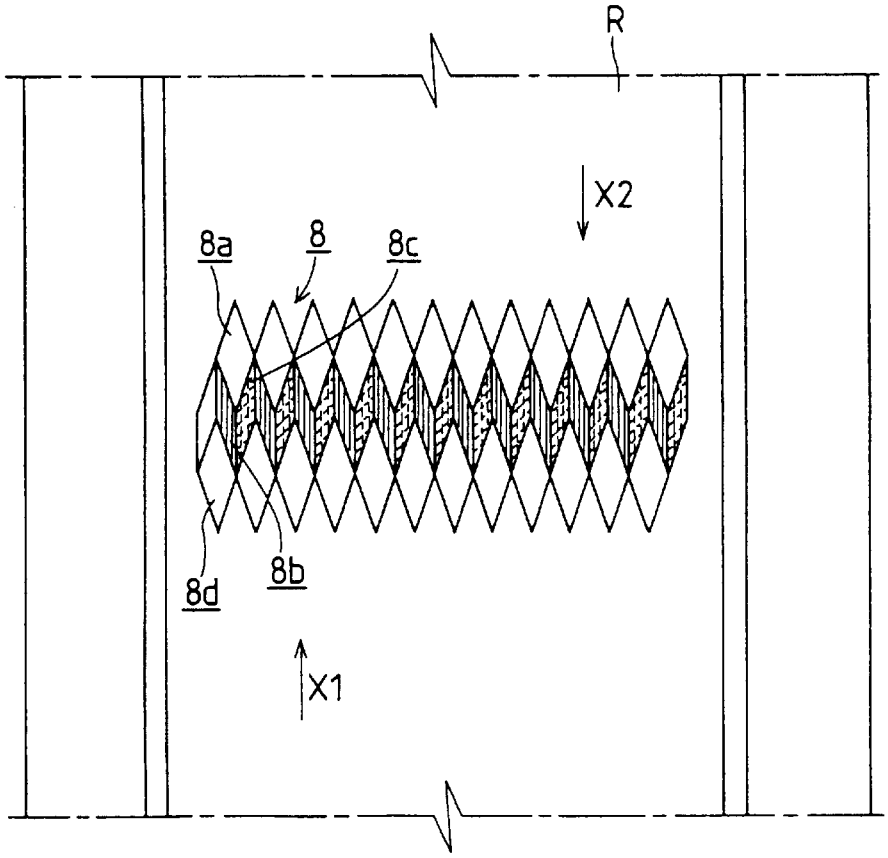
FIG. 10 is a plan view showing a constitution of a further different embodiment of the invention.

As such square columnar marking pattern, still more, as shown in FIG. 10, square columnar marking patterns 8 may be arranged on the road R so as to be recognized three-dimensionally from both the running lane and the opposite lane. This square columnar marking pattern 8, when seen from the direction of arrow X1, is composed of a sheet piece 8*a* forming the top side in white (Munsell value about 9), a sheet piece 8*b* forming the left side in red (Munsell value about 5), and a sheet piece 8*c* forming the right side in yellow (Munsell value about 6). At the nearer side, a sheet piece 8*d* in white (Munsell value about 9) is formed as a linkage sheet for linking these plural marking patterns 8 . . . 8. On the other hand, when seen from the opposite lane confronting the running lane in the direction of arrow X1, that is, from the direction of arrow X2, the sheet piece 8*a* of this constitution forming the top side forms a linkage sheet, and the linkage sheet 8*d* forms the top side. Thus, the marking patterns 8 . . . 8 arranged in a row for marking the stop-line of the road R are composed of sheet pieces 8*a*, 8*b*, 8*c*, 8*d* having different lightness degrees, as mentioned above, in the directions of both running lane and opposite lane, so that the square columnar solid shape can be recognized visually.

Figure 12:
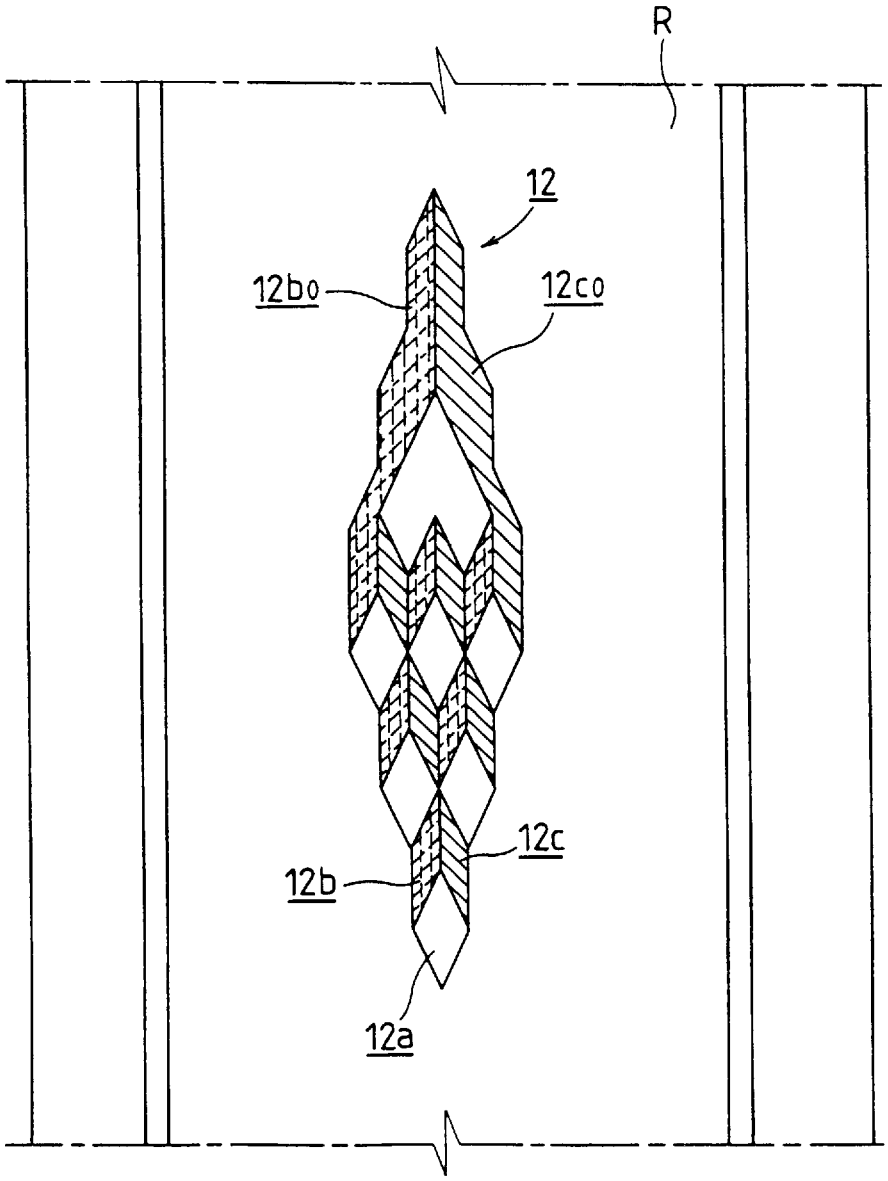
FIG. 12 is a plan view showing a constitution of still other different embodiment of the invention.

As the constitution for arranging a plurality of marking patterns, a modified example as shown in FIG. 12 may be also applied.

This road traffic sign 12 is composed to express the median strip of the road R. A plurality of square columnar solid patterns composed of a sheet piece 12*a* in white (Munsell value about 9) formed on the top side, a sheet piece 12*b* in yellow (Munsell value about 6) formed on the left side, and a sheet piece 12*c* in red (Munsell value about 5) formed on the right side are arranged continuously, and a continuous sheet $\mathbf{12}b_0$ consecutive to the left side, and a continuous sheet $\mathbf{12}c_0$ consecutive to the right side are arranged continuously.

Figure 11:
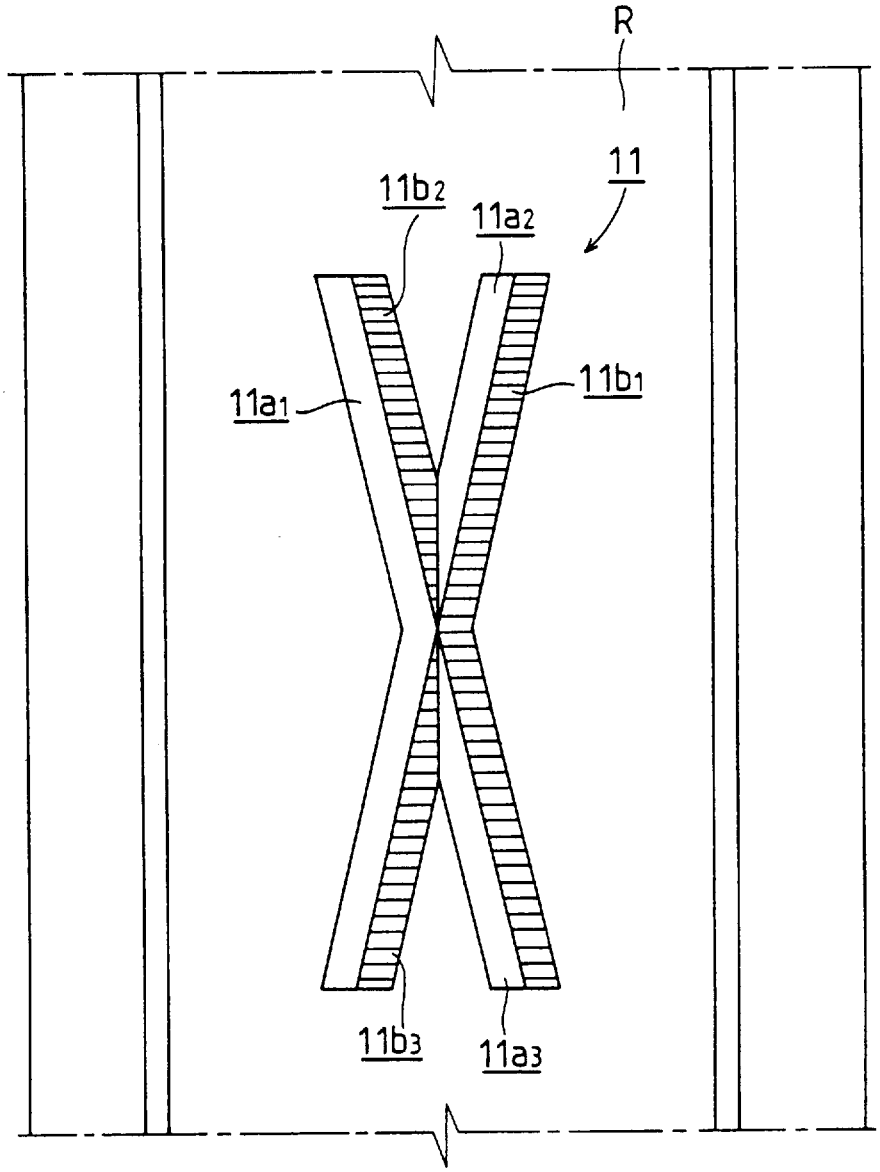
FIG. 11 is a plan view showing a constitution of a still different embodiment of the invention.

As the constitution for expressing such median strip of the road R, other example is shown in FIG. 11.

Sheet pieces $\mathbf{11}a_1$, $\mathbf{11}a_2$, $\mathbf{11}a_3$ white (Munsell value about 9) are arranged on the top side, and sheet pieces $\mathbf{11}b_1$, $\mathbf{11}b_2$, $\mathbf{11}b_3$ in blue (Munsell value about 3) are arranged on the right side. In this constitution, the road traffic sign 11 is recognized as a solid figure bulged up on an X-form in the state as if illuminated from the left side in the diagram.

Figure 13:
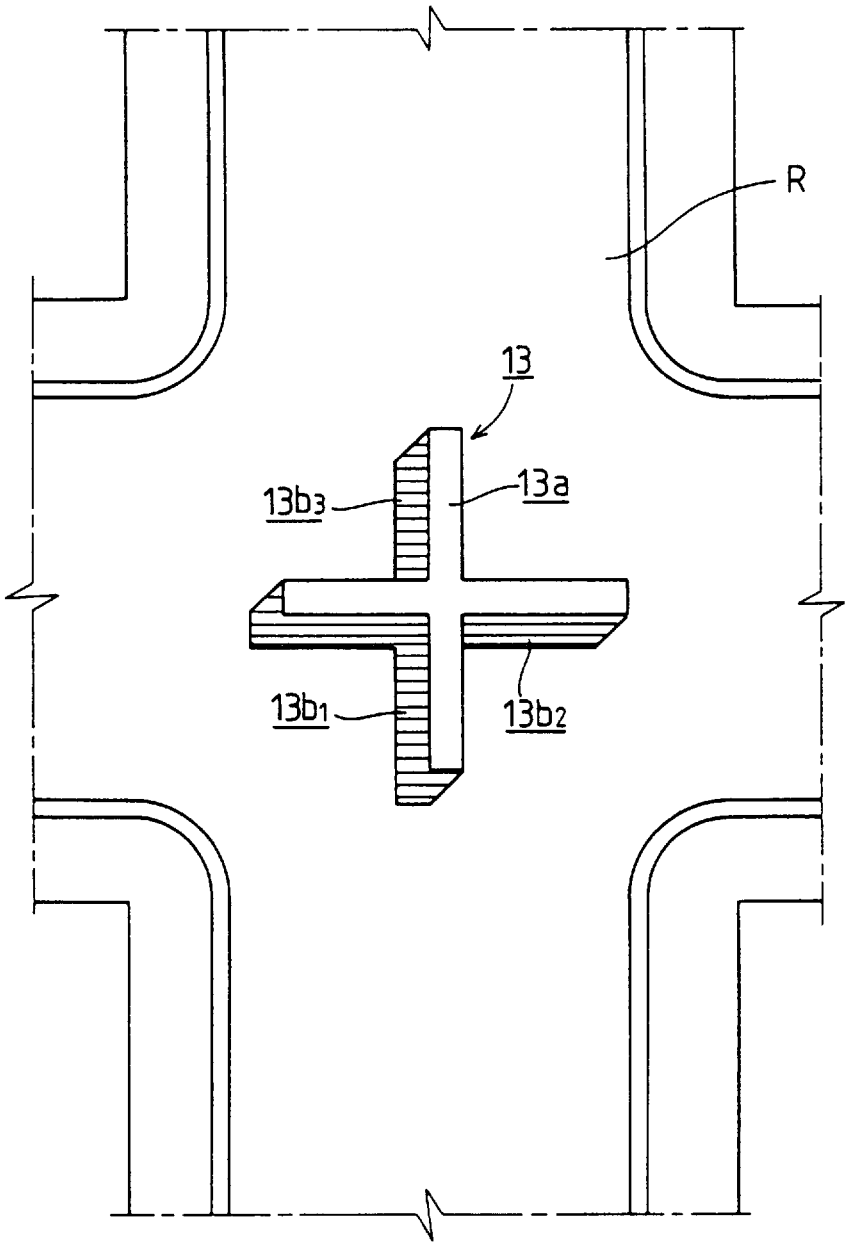
FIG. 13 is a plan view showing a constitution of a still further different embodiment of the invention.

Further, FIG. 13 shows a constitution of another different embodiment. In this road traffic sign 13, to express the intersection on the road R, a sheet piece 13*a* in white (Munsell value about 9) is formed on the top side, and sheet pieces $\mathbf{13}b_1$, $\mathbf{13}b_2$, $\mathbf{13}b_3$ in blue (Munsell value about 3) are formed on the sides, thereby forming the road traffic sign 13 in a cross form. By the arrangement of the sheet pieces 13*a*, $\mathbf{13}b_1$, $\mathbf{13}b_2$, $\mathbf{13}b_3$ for forming the road traffic sign 13 with a lightness difference, the road traffic sign 13 is recognized as a bulged solid cross form in the state as if illuminated from the right front upper side in the diagram.

The above embodiments refer to the visual image of solid shape in convex form, but such solid shape may be also a visual image in concave form.

Figure 14:
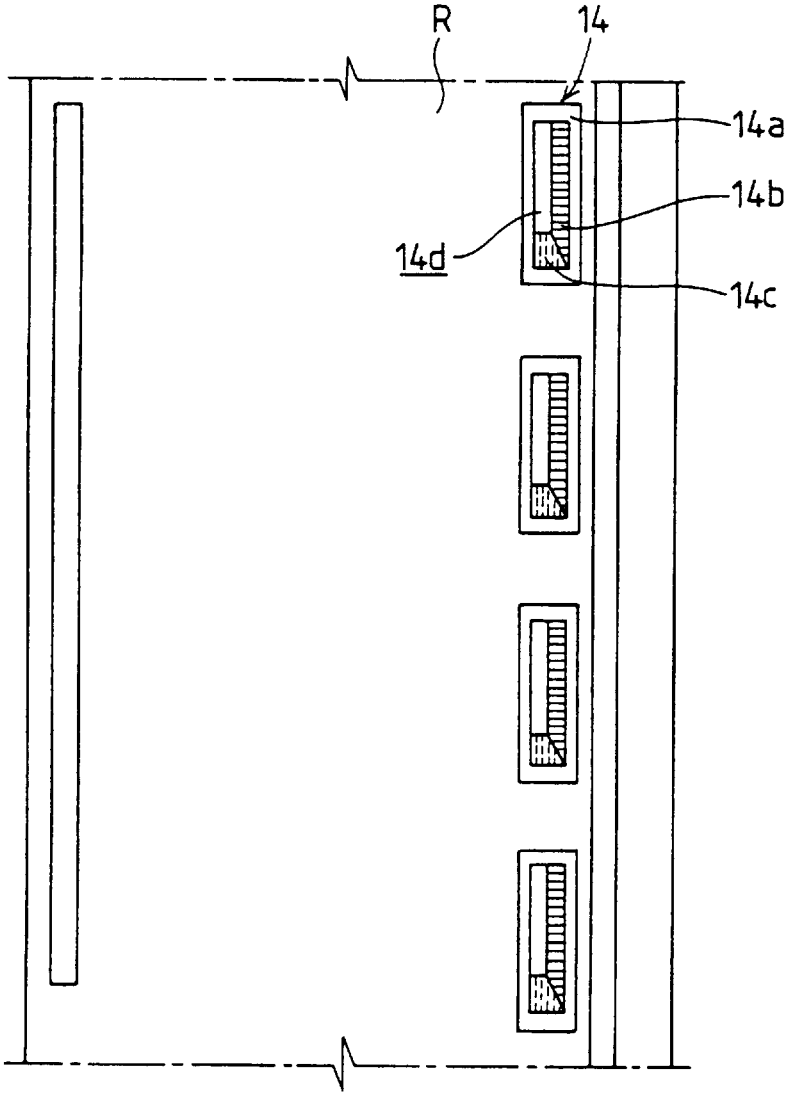
FIG. 14 is a plan view showing a constitution of another embodiment of the invention.
Figure 15:
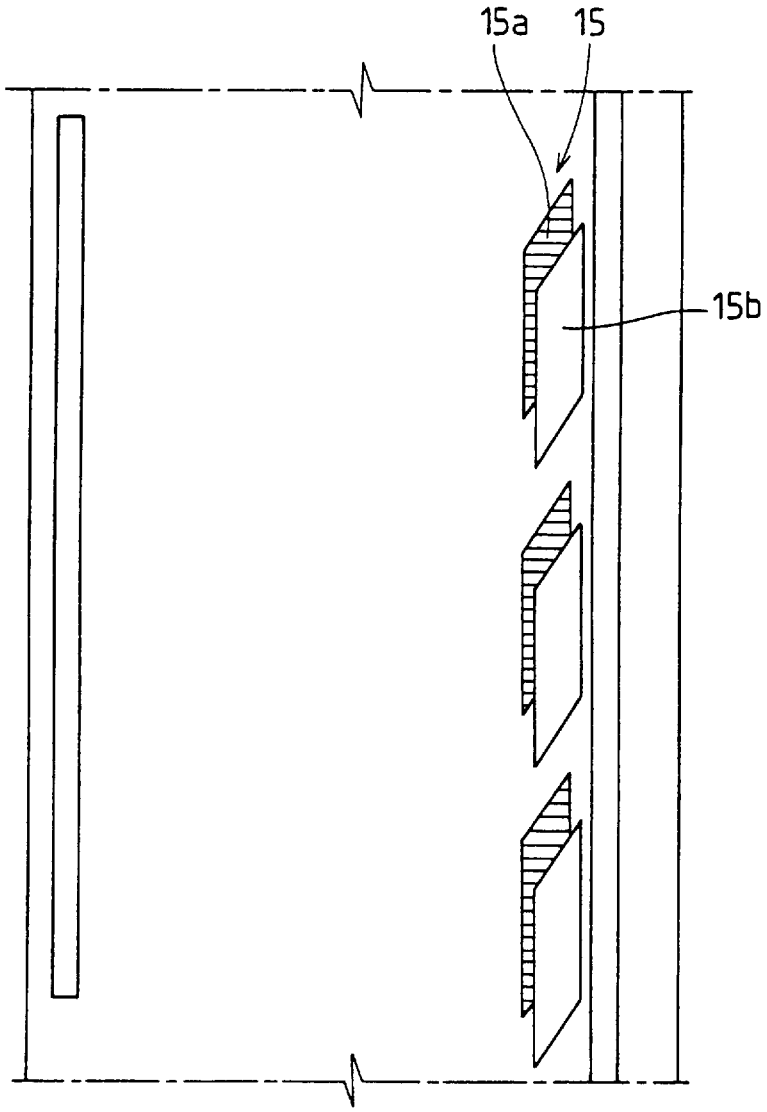
FIG. 15 is a plan view showing a constitution of still another embodiment of the invention.

Embodiments shown in FIG. 14 and FIG. 15 relate to visual images looking as if grooves were formed in the road surface.

A road traffic sign 14 shown in FIG. 14 is formed along the edge of road R, whose inner space is rectangularly hollowed to be divided into three sections, and is composed of a sheet piece 14*b* in blue (Munsell value about 3) and a sheet piece 14*c* in sky-blue (Munsell value about 7) as two of the three sections and a sheet piece 14*a* in white (Munsell value about 9) arranged around the rectangle. A divided section 14*d* is the surface of the road R itself, which is composed of asphalt. By disposing a plurality of thus constituted road traffic signs 14, a visual image recognizing a state of forming of plural grooves is obtained in the edge portion along the running lane in the road R. As a constitution for obtaining such concave form solid image, further, a constitution as shown in FIG. 15 may be considered. This road traffic sign 15 is formed along the edge of the road R same as in FIG. 14, and is composed of a sheet piece 15*b* of parallelogram in white (Munsell value about 9) and a sheet piece 15*a* of parallelogram in blue (Munsell value about 3). The sheet piece 15*a,* having a shape formed as being deviated in one direction to the sheet piece 15*b,* is adjacent to two sides adjoined each other of the sheet piece 15*b* of parallelogram. By disposing a plurality of such road traffic signs 15, same as in FIG. 14, plural concave solid images formed in the edge portion along the running lane of the road R can be visually recognized.

The road traffic signs in solid pattern formed by disposing plural sheet pieces are not limited to the above-mentioned linear and geometric patterns only, but may be expressed in characters, curved shapes or other solid figures.

When using such sheet pieces, they are adhered on the road to form the marking patterns. Such sheet material may be obtained by curing hot-melt type such as rosin resin and petroleum resin, or epoxy resin, polyester resin, or acrylic compound. Furthermore, these sheet materials may be mixed with recursive reflection material such as glass beads, or light reserve material, and in the composition blended with such recursive reflection material or light reserve material, a sufficient lightness may be maintained at night only by a slight illumination or headlight, and the visual recognition is not lowered.

In the illustrated examples, each divided section the marking pattern is formed of a sheet piece, but the shape of the material for composing the sections may be either plate or block. When using materials of such shape, they may be partly buried in the road, and partly exposed. As the shape of the material for composing sections, moreover, a coat film may be used. The coat film is formed by applying a paint on the road.

As plate and block materials, artificial stone concrete, concrete, brick, tile, glass, asphalt, metal, synthetic resin, and ceramics may be properly used. This metal materials may include color iron and steel sheet and alminum plate.

As the material for forming a coat film, paints such as water-based paint such as acrylic emulsion, oil-based paint such as carpenter's paint, and colored matter such as white cement maybe used.

What is claimed is:

1. A road traffic sign of a solid graphic pattern, being a road traffic sign having a marking pattern divided in a plurality of sections formed tightly on the road, the road sign comprising first and second sections, the first section having a first lightness and being visible when viewed from a selected direction, the second section being adjacent to and substantially coplanar with the first section, the second section having a second lightness that is different than the first lightness and being visible when viewed from the selected direction, the first and second sections forming a two-dimensional marking pattern with a visual image of the marking pattern in a solid figure, when viewed from the selected direction, having a three-dimensional appearance.

2. A road traffic sign of a solid graphic pattern of claim 1 wherein the first lightness is different than the second lightness by a Munsell value of 1 or more, and the lightness of each of the first and second sections is selected in the lightness value in two to four stages set at mutually different Munsell values.

3. A road traffic sign of a solid graphic pattern of claim 1 or claim 2 wherein the first section is colored in a first hue, and the second section is colored in a second hue that is different than the first hue.

4. A road traffic sign of a solid graphic pattern of claim 1 wherein the first and second sections are each formed of a sheet of selected material and the sheet of selected material is adhered to the road.

5. A road traffic sign of a solid graphic pattern of claim 1 wherein the first and second sections have a shape of one of a plate form and a block form, and the first and second sections are partly buried in the road and partly exposed.

6. A road traffic sign of a solid graphic pattern of claim 5 wherein each of the first and second sections is formed by at least one of artificial stone concrete, concrete, brick, tile, glass, asphalt, metal, synthetic resin, and ceramics.

7. A road traffic sign of a solid graphic pattern of claim 1 wherein each of the first and second sections is a coat film, and this coat film is formed by applying a paint on the road.

8. A road traffic sign of a solid graphic pattern of claim 7 wherein the coat film is at least one of a water-based paint, oil-based paint, colored white cement, colored asphalt, and colored emulsifier.

9. A road traffic sign of a solid graphic pattern of claim 1 wherein the first and second sections are formed of a selected hot melt that includes rosin resin and petroleum resin.

10. A road traffic sign of a solid graphic pattern of claim 1 wherein the first and second sections are formed of a selected material including epoxy resin and polyester resin.

11. A road traffic sign of a solid graphic pattern of claim 1 wherein each of the first and second sections is a molding obtained by curing an acrylic compound.

12. A road traffic sign of a solid graphic pattern of claim 1 wherein each of the first and second sections include one of a recursive reflection material and a heat reserve material mixed therein.

13. A road traffic sign of a solid graphic pattern of claim 1 wherein the solid figure defined by the marking pattern is a drawing on the road by stereographic projection.

* * * * *